US005119848A

United States Patent [19]

Muguruma et al.

[11] Patent Number: 5,119,848

[45] Date of Patent: Jun. 9, 1992

[54] TWO-FLUID INJECTION APPARATUS AND A MANUFACTURING APPARATUS INCLUDING SUCH INJECTING APPARATUS FOR MANUFACTURING MINIMIZED SPANGLE MOLTEN PLATED STEEL PLATE

[75] Inventors: Nobuyoshi Muguruma; Kazuo Takagi; Hidekazu Kawano; Kuniaki Kishi; Masakazu Kobuchi, all of Sakai, Japan

[73] Assignee: Nisshin Steel Co., Ltd., Tokyo, Japan

[21] Appl. No.: 476,414

[22] PCT Filed: Sep. 30, 1988

[86] PCT No.: PCT/JP88/01009

§ 371 Date: May 29, 1990

§ 102(e) Date: May 29, 1990

[87] PCT Pub. No.: WO90/03451

PCT Pub. Date: Apr. 5, 1990

[51] Int. Cl.[5] ..... B08B 3/02

[52] U.S. Cl. ..... 134/64 R; 134/122 R; 134/199; 134/181; 134/102; 427/349; 239/390

[58] Field of Search ..... 118/63; 427/439, 349, 427/348; 62/374, 63; 148/156; 237/513; 134/199, 122 R, 64 R, 181, 183, 102

[56] References Cited

U.S. PATENT DOCUMENTS

| | | | |
|---|---|---|---|
| 3,459,587 | 8/1969 | Hunter et al. | 427/340 |
| 3,932,683 | 1/1976 | Robins et al. | 427/340 |
| 4,041,895 | 8/1977 | Overton et al. | 427/349 X |
| 4,343,434 | 8/1982 | Haruch | 239/390 |
| 4,418,100 | 11/1983 | Bedwell et al. | 427/349 X |
| 4,513,033 | 4/1985 | Patil et al. | 427/349 |
| 4,527,506 | 7/1985 | Hoetzl | 239/455 X |
| 4,594,272 | 6/1986 | Haaser | 427/349 |
| 4,784,321 | 11/1988 | Delaplace | 239/390 |

FOREIGN PATENT DOCUMENTS

| | | |
|---|---|---|
| 0124408 | 4/1984 | European Pat. Off. . |
| 2426741 | 12/1979 | France . |
| 51-137628 | 11/1976 | Japan . |
| 53-31039 | 3/1978 | Japan . |
| 58-150456 | 9/1983 | Japan . |
| 2155790 | 5/1973 | United Kingdom . |
| 2009250 | 11/1978 | United Kingdom . |

OTHER PUBLICATIONS

Patent Abstracts of Japan, vol. 4, No. 61 (C-9)[543 , May 8, 1980.

Patent Abstracts of Japan, vol. 7, No. 69 (C-158)[1214], Mar. 23, 1983.

*Primary Examiner*—Frankie L. Stinson

*Attorney, Agent, or Firm*—Wenderoth, Lind & Ponack

[57] ABSTRACT

An apparatus for injecting two fluids is provided with a first elongated header which extends in a straight line and is supplied with a first fluid, a second elongated header which extends along the first header and is fixed to the backside of the first header, a nozzle lead-in member for leading the first fluid from the first header and the second fluid from the second header, and a nozzle for mixing and injecting the fluids from the nozzle lead-in member. Such apparatus for injecting two fluids has a simple construction and can be produced efficiently. In using this apparatus for injecting two fluids in manufacturing minimized spangle molten plated steel plate, for which water atomized by compressed air is injected toward a surface of the steel plate strip running from bottom to top while passing through a plating bath, a main spangle removing mechanism and a spare spangle removing mechanism are provided and operated selectively and alternately, so that operation can be continued even when either of the mechanisms breaks down.

24 Claims, 9 Drawing Sheets

TWO-FLUID INJECTION APPARATUS AND A MANUFACTURING APPARATUS INCLUDING SUCH INJECTING APPARATUS FOR MANUFACTURING MINIMIZED SPANGLE MOLTEN PLATED STEEL PLATE

FIELD OF THE INVENTION

This invention relates to a two-fluid injecting apparatus, and more particularly to a two-fluid injecting apparatus for mixing and injecting air and various treatment fluids on the surface of a strip to be treated, such as steel strip, plastic or paper.

This invention also relates to a manufacturing apparatus of minimized spangle molten plated steel plate.

DESCRIPTION OF THE PRIOR ART

A typical prior art apparatus is disclosed, for example, in Japanese Laid-Open Patent Pub. 137628/1976, in which a pair of spangle removing apparatus are disposed across a strip in a casing having a passage for a steel strip running from bottom to top while passing through the plating bath. In this apparatus, air headers elongated in the strip widthwise direction, water headers elongated in the strip widthwise direction, and multiple branch pipes extending in the vertical direction are disposed at equal intervals along the strip widthwise direction, and nozzles are attached to these branch pipes.

In this prior art, since the intervals between the nozzles are narrow, it is very difficult to replace the nozzles when clogged. This nozzle replacing job is done by slowing down the strip running speed. As a result the working efficiency is lowered, defective products may be produced, and steam is blown out from nozzles such that the working environment becomes extremely impaired.

Besides, in the prior art, there are many constituent elements, and the size is increased, the weight is increased, and maintenance is troublesome.

In order to solve the above problems, it is a primary object of this invention to present an injecting apparatus which is light and compact, and arranged such that a clogged nozzle can be easily replaced, as well as a manufacturing apparatus of minimized spangle molten plated steel plate which utilizes such injecting apparatus.

SUMMARY OF THE INVENTION

To achieve the above object, a two-fluid injecting apparatus of this invention comprises:

a first elongated header which extends in a straight line and is supplied with a first fluid;

a second elongated header which extends along the first header, is fixed to a first side of the header, and is supplied with a second fluid; plural nozzle lead-in members penetrating from a second side of the first header to the first side of the first header and having a first path for leading the first fluid in the first header and a second path for leading the second fluid in the second header; and a nozzle, for mixing and injecting the first fluid and the second fluid, detachably installed in the nozzle lead-in member, and having passages individually communicating with the first and second paths.

According to the invention, the first fluid supplied to the first header is lead through the first path to a passage provided in the nozzle. The second fluid supplied to the second header is lead through the second path of the nozzle lead-in member to the passage provided in the nozzle. Since the passage communicates with the first and second paths individually, the first and second fluids supplied are mixed and injected from the nozzle. When the nozzle is clogged, the first and second headers can be removed and the clogged nozzle, can be replaced with a new one, or the headers can be replaced immediately with spare headers provided with a nozzle which is not clogged.

According to the invention, the first header which leads the first fluid and the second header which leads the second fluid are generally connected so that if the nozzle is clogged, it is easy to take out the headers and replace the nozzle with a spare one, which enables prompt replacement work, a reduction in the work required for maintenance, and an improvement in efficiency. Since it is not necessary to provide a branch tube in each respective nozzle, the construction may be simplified and light and compact.

In a preferred embodiment of this invention, in the nozzle lead-in members, plural first paths are formed on the outer circumference of the second path and are spaced apart in the peripheral direction.

In a different preferred embodiment, the first fluid is air, and the second fluid is water or a liquid including water, and the second fluid is atomized and injected by the nozzle, using the first fluid.

In a further different preferred embodiment, the first and second headers are disposed along the widthwise direction of the strip to be treated, and the plural nozzle lead-in members and the nozzles individually corresponding to each of the plural nozzle lead-in members are spaced apart along the widthwise direction.

In a still different preferred embodiment, the apparatus further comprises a first pipe connection tube attached to one longitudinal end of the first header, and a second pipe connection tube attached to one longitudinal end of the second header.

Moreover, in order to achieve the above object, a manufacturing apparatus for manufacturing minimized spangle molten plated steel plate according to this invention has a pair of spangle removing apparatus mounted in opposing relation to one another across a steel plate strip in a casing having a passage for the strip running from bottom to top while passing through a plating bath, wherein the spangle removing apparatus comprises a main spangle removing means and a spare spangle removing means disposed downwardly of the main spangle removing means, each of the main spangle removing means and spare spangle removing means comprising:

a first elongated header which extends in a widthwise direction of the strip and is supplied with a first fluid comprising one of a gas and a liquid;

a second elongated header which extends along the first header, is fixed at a first side of the header, and is supplied with a second fluid comprising the other one of the gas and the liquid;

plural spaced apart nozzle lead-in members mounted along the widthwise direction through the first header, and including a first path for leading the first fluid from the first header and a second path for leading the second fluid from the second header; and a nozzle, for mixing, atomizing and injecting the first and second fluids, detachably installed in each of the nozzle lead-in members and having passages individually communicating with the first and second paths.

The main spangle removing means and spare spangle removing means being operated alternately.

According to the invention, a pair of spangle removing apparatus are disposed at both sides of the strip running from the bottom to top while passing through the plating bath. The spangle removing apparatus includes the main spangle removing means and the spare spangle removing means which are operated alternately and selectively.

Referring to the main and spare spangle removing means operated alternately and selectively, upon operating the main spangle removing means, the first fluid supplied to the first header is led through the first path of the nozzle lead-in members into a passage provided in the nozzle. The second fluid supplied to the second header is led through the second path of the nozzle lead-in member into the passage provided in the nozzle. The passage communicates with the first and second paths individually, so that the supplied and first and second fluids are mixed and injected from the nozzle. The first and second fluids thus mixed are sprayed in an atomized state from the nozzle of the main spangle removing means onto the strip running from bottom to top in the passage. During injection of the first and second fluids by the main spangle removing means, when the nozzle becomes clogged, the first and second headers can be taken out and the clogged nozzle can be replaced with a new one or a spare header provided with a nozzle which is not clogged can be immediately disposed at the position of the removed header.

During such replacing of the nozzle or header, the spare spangle removing means is operated, and by means of such operation as the main spangle removing means, the first and second fluid may be mixed and injected from the nozzle.

According to the invention, when the nozzle is clogged, the header can be taken out and the nozzle or the header can be replaced immediately with spare ones. Moreover, since the main and spare spangle removing means can be properly exchanged and used, the first and second fluids can be injected by at least either of the main and spare spangle removing means. Accordingly, it is not necessary to lower the running speed of the strip, thereby improving work efficiency.

In a preferred embodiment, the manufacturing apparatus comprises also a main convection preventing plate which is spaced from the strip, extends down from below the main spangle removing means, and reaches the rear part of the nozzle header of the spare spangle removing means; and a spare convection preventing plate which is spaced from the strip, extends down from below the nozzle of the spare spangle removing means, and reaches the drain trap.

In a different preferred embodiment, the main spangle removing means and spare spangle removing means are set on rails which guide them in the longitudinal direction, in which the main spangle revoving means and spare spangle removing means are each movable in the longitudinal direction along each rail.

In a further different preferred embodiment, the main spangle removing means and spare spangle removing means are each provided with means for angularly adjusting the nozzles about an axial line parallel to the first header.

In a still different preferred embodiment,. the main spangle removing means and spare spangle removing means are each provided with means for approaching and retracting away from the strip.

DETAILED DESCRIPTION OF THE PREFERRED EMBODIMENTS

Figure 1:
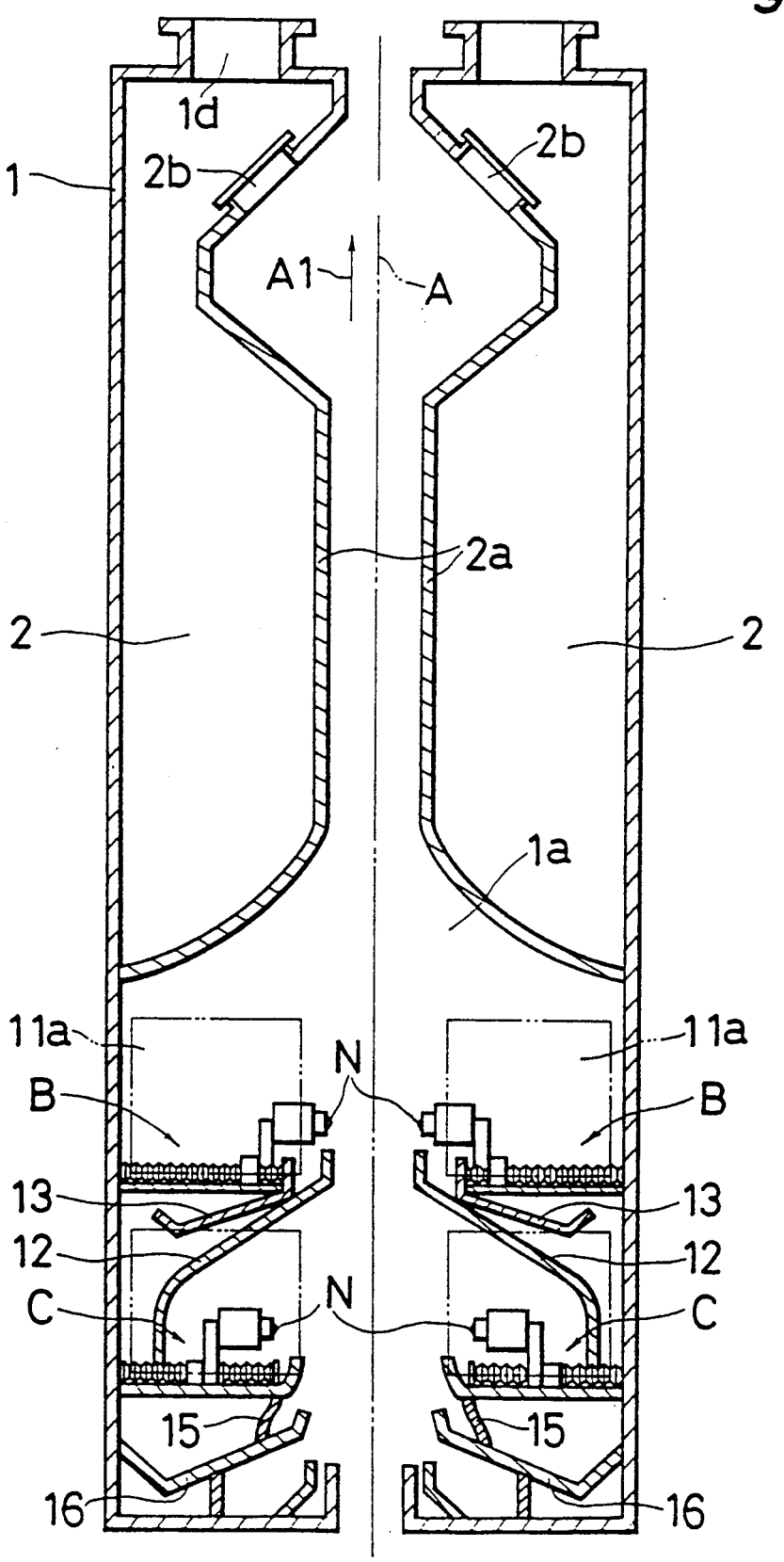
FIG. 1 is a sectional view of a manufacturing apparatus of minimized spangle molten plated steel plate in one of the embodiments of this invention, as seen from the front side.
Figure 2:
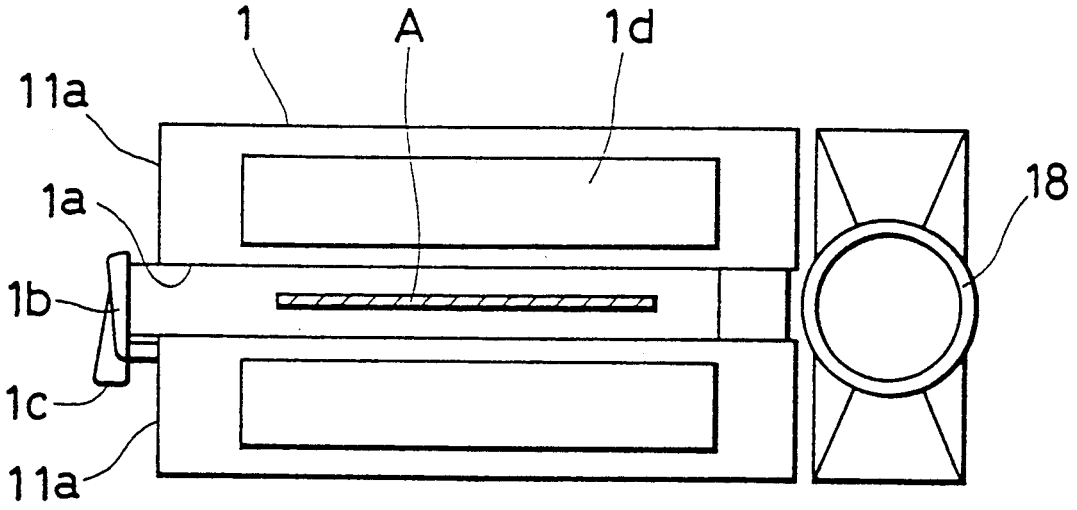
FIG. 2 is a plan view showing an embodiment of the same manufacturing apparatus.
Figure 3:
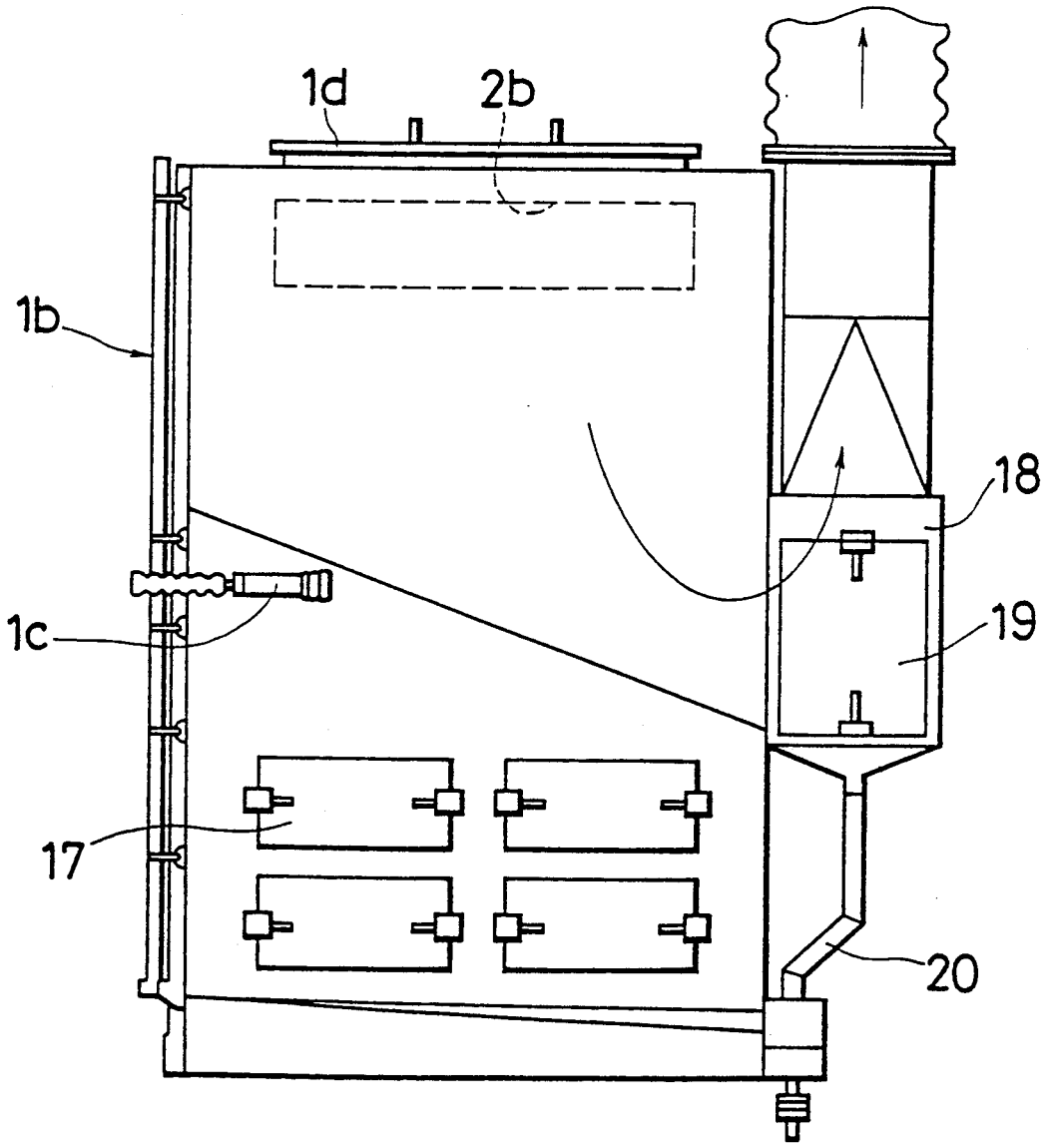
FIG. 3 is a right side elevation view of the manufacturing apparatus.

Referring now to the drawings, embodiments of this invention are described below. In FIG. 1, in a casing 1 having a rectangular parallelepiped contour and including a passage 1*a* for a steel strip A moving from bottom to top while passing through a plating bath, main spangle removing means B are disposed across the strip A. A passage door 1*b* is provided at one side of the strip passage 1*a*, and an opening cylinder 1*c* of the door 1*b* is disposed on the casing outer wall as shown in FIG. 2. In the upper part of the casing, there is an opening 1*d* for adjusting the mist suction volume as shown in FIG. 3. Inside the casing 1, a mist chamber 2 is formed by a mist guide wall 2*a* extending from above the spangle removing means B to the upper end of the casing 1, and an opening 2*b* for sucking the mist is provided in the upper part of the wall 2*a* in such a manner that the opening area may be adjusted by a damper.

In this apparatus, a spangle removing apparatus comprises the main spangle removing means B and a spare spangle removing means C spaced beneath it. The spangle removing means C is mounted above a drain trap 16 located at the bottom of the casing 1. The main spangle removing means B and the spare spangle removing means C have substantially the same construction.

Figure 4:
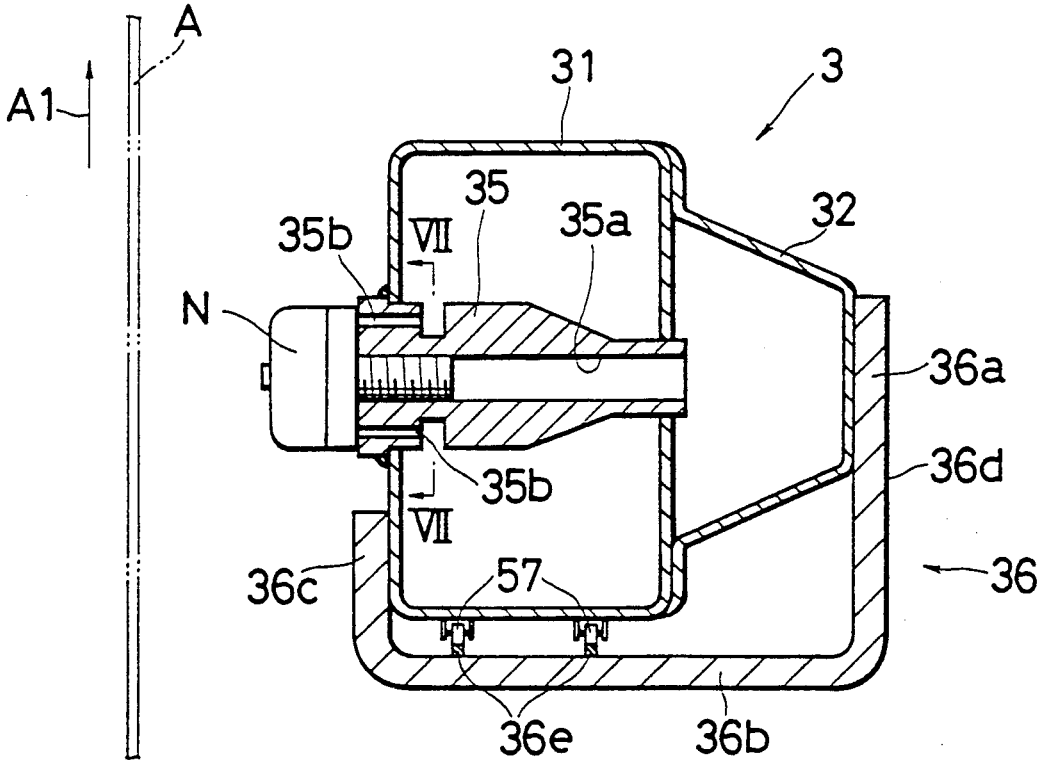
FIG. 4 is a sectional view of a header in a direction transverse to the lengthwise direction.

FIG. 4 shows the main spangle removing means B. The main spangle removing means B possesses plural nozzles N disposed at equal intervals along the strip widthwise direction, and a nozzle header 3 mounting them detachably as shown clearly in FIG. 5.

Figure 7:
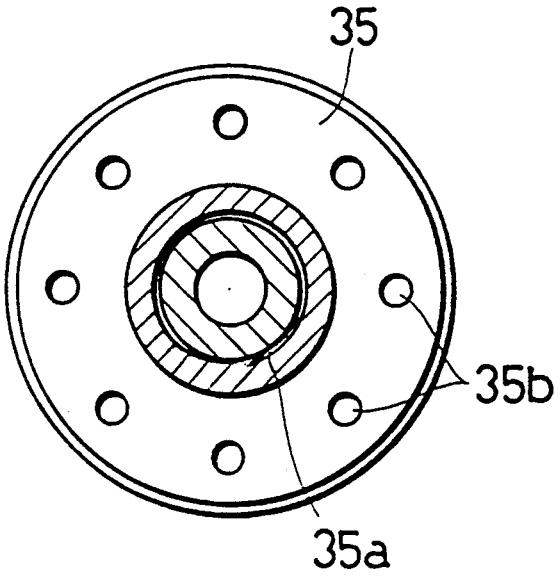
FIG. 7 is a sectional view taken along line VII–VII in FIG. 4.

The nozzle header 3 comprises an air header 31 which is a first header and is elongated in the widthwise direction of the strip A, and a liquid header 32 which is a second header and is elongated in a direction parallel to the air header 31, and attached to the rear side of the air header 31 (i.e. the side opposite to the strip A with respect to the air header 31). At one end of the headers 31, 32 in the lengthwise direction, individual pipe connection tube ports 33, 34 are attached, and extend parallel in the lengthwise direction of the headers 31, 32 and are directed away from one end thereof (rightward in FIG. 5). The air header 31 has plural nozzle lead-in members 35 mounted along the air header 31 at intervals, for example, equal intervals. The lead-in members 35 are mounted through the air header 31 in the longitudinal direction of the lead-in members 35 (i.e. the direction perpendicular to the strip A in FIG. 4). Each of these members 35 is approximately cylindrical, and as clear from FIG. 7, includes a liquid passage 35*a* extending longitudinally therethrough along the central axis thereof, and a nozzle N is detachably fitted to an end of each of the members 35, whereas the rear end of the fluid passage 35*a* opens into the liquid header 32. As clear from FIG. 7, each of the members 35 is provided with plural air passages 35*b* formed at, for example, equal intervals about the liquid passage 35*a* through the portion of the member 35 connected to the nozzle N.

Figure 8:
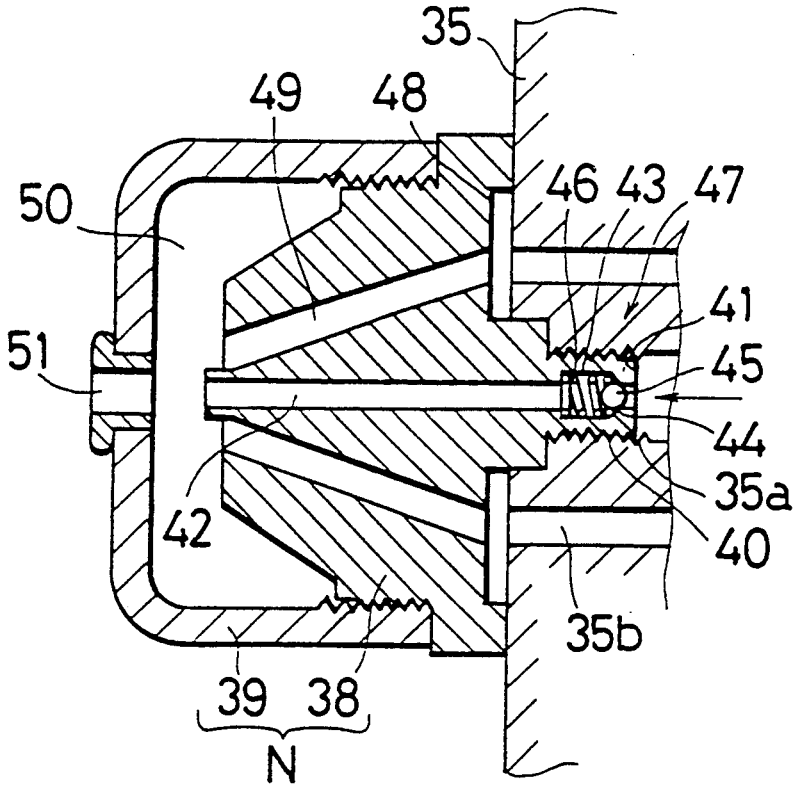
FIG. 8 is a sectional view of a nozzle.
Figure 9:
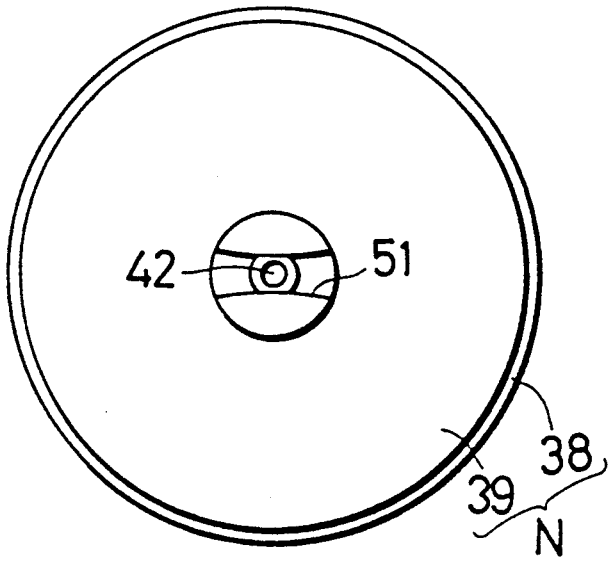
FIG. 9 is a front elevation of the nozzle.

FIG. 8 is a sectional view of nozzle N, and FIG. 9 is its front view as seen from the left side of nozzle N in FIG. 8. As shown in these drawings, the nozzle N includes a nozzle tip 38, and a cap 39 which is screwed onto the end of this nozzle tip 38. The external threads 40 of the nozzle tip 38 are engaged with the internal threads formed in the liquid passage 35*a* of the nozzle lead-in member 35, and the nozzle N is detachably fitted to the nozzle lead-in member 35 as stated above. The axial line of the nozzle tip 38 is on a straight line common to the axial line of the nozzle lead-in member 35, and a liquid passage 42 is formed on this axial line. The liquid passage 42 communicates with a valve chamber 43 formed at a rear end part 41 of the nozzle tip 38. In this valve chamber 43 are incorporated a valve disc (or ball) 45 to be seated on a valve seat 44, and a spring 46 for elastically thrusting the valve disc 45 by resisting the pressure of the liquid from the passage 35*a*, thereby composing a check valve 47. When the liquid from the liquid header 32 is pressure-fed, the valve disc 45 is displaced leftward in FIG. 8 against the spring force of the spring 45 such that it is spaced from the valve seat 44, so that the liquid is pressure-fed into the liquid passage 42.

An annular recess 48 is formed in the nozzle tip 38, concentric with the axial line of the nozzle tip 38, and air passages 49 communicating with this annular recess 48 are formed peripherally about the liquid passage 42. These air passages 49 are inclined toward the center as it approaches the end (the left end in FIG. 8) of the nozzle tip 38. The annular recess 48 communicates with the air passage 35*b* formed in the nozzle lead-in member 35.

The cap 39 fitted to the nozzle tip 38, together with the nozzle tip 38, forms a mixing chamber 50 for mixing liquid and air. This cap 39 posses a flat nozzle hole 51 extending in the widthwise direction of the strip A on the extension of the axial line of nozzle tip 38.

The pressure of the air pressure-fed into the air header 31 is, for example, 4 kg/cm$^2$, and the pressure of the liquid pressure-fed into the liquid header 32 is, for example, 1.5 kg/cm$^2$. The ratio $\alpha(=S1/S2)$ is preferably about 50/1, where S1 is the sum of the sectional areas of the plural air passages 49 formed in the nozzle tip 38 and S2 is the sum of the sectional areas of the plural liquid passages 42 formed in the nozzle tip 38. Therefore, the air pressure-fed into the air header 31 is injected into the mixing chamber 50 from the air passage 35*b* of the nozzle lead-in member 35 through the air passage 49 of the nozzle N. The liquid pressure-fed into the liquid header 32 at this time is introduced into the liquid passage 42 of the nozzle N from the liquid passage 35*a* of the nozzle lead-in member 35 into the liquid passage 42 of the nozzle N through the check valve 47, and is then injected from the liquid passage 42. In this way, the liquid is injected from the nozzle hole 51 in an atomized state, and is sprayed onto the surface of the strip A which is flat along its widthwise direction.

Figure 5:
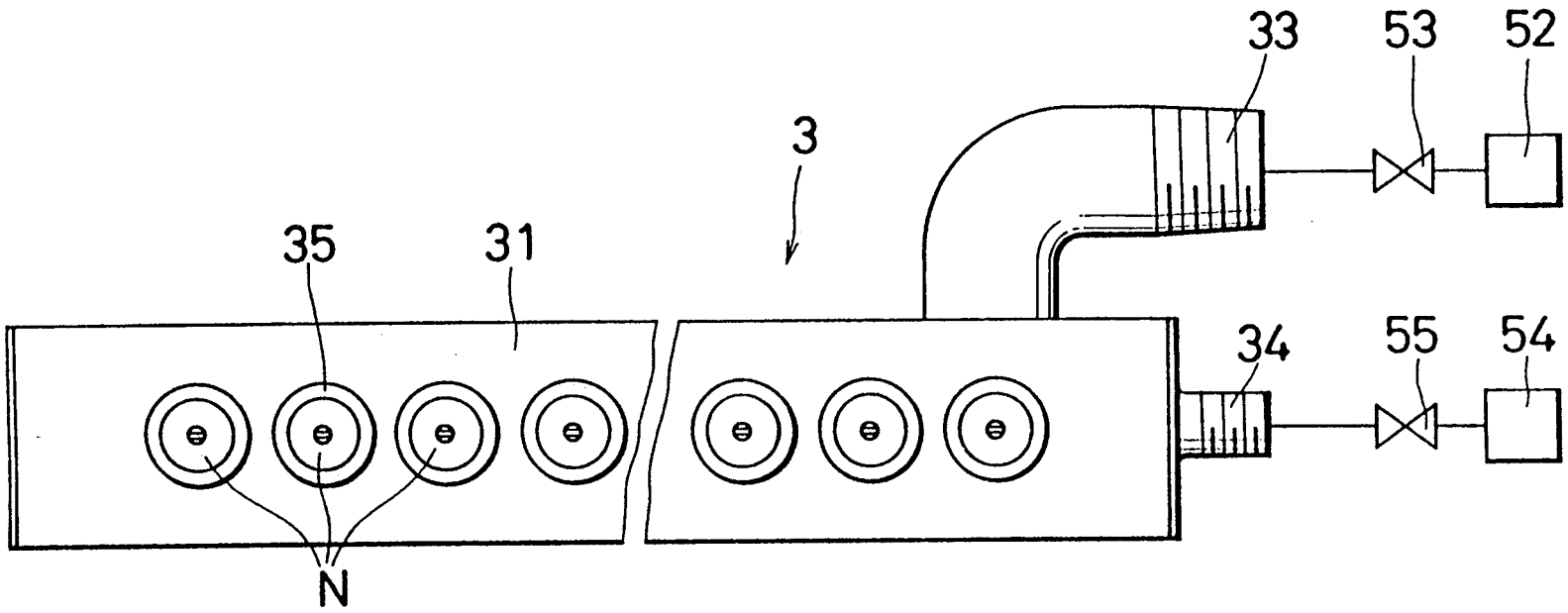
FIG. 5 is a front elevation of the header.
Figure 6:
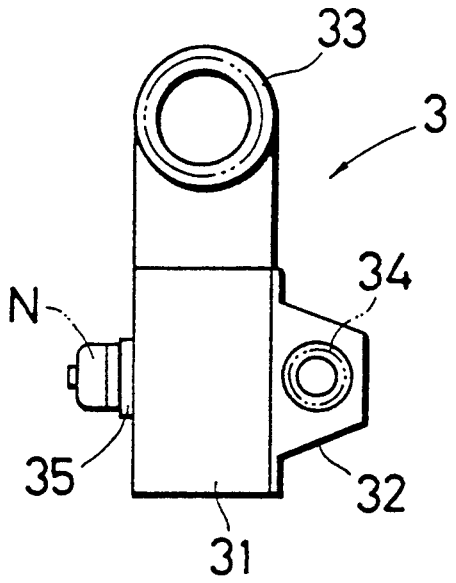
FIG. 6 is a right side elevation of the header.

Compressed air is supplied into the tube connection port 33 connected to the air header 31 from the air pressure source 52 by way of a switching valve 53 as shown in FIG. 5. Liquid is pressure-fed into the tube connection cylinder 34 attached to the liquid header 32 from the liquid supply source 54 through a switching valve 55. When the switching valve 55 is closed, in order to prevent dropping of the liquid from the liquid passage 42 of the nozzle tip 38 and the nozzle hole 51, the check valve 47 is closed as the valve disc 45 is pressed by the spring force of the spring 46 against the valve seat 44.

A slide guide means 36 is provided for guiding and supporting both the headers 31, 33 slidably in their lengthwise direction. In this slide guide means 36, rails 36*e* are fixed on a lower wall 36*b* which is formed by an irregular shaped grooved steel web 36*a*, and wheels 57 of the header 31 are supported by the rails 36*e*, such that the headers 31, 32 are positioned and guided in the longitudinal direction between the front wall 36*c* which is a short flange and the rear wall 36*d* which is a long flange. The rails 36*e* extend in the widthwise direction of the strip A.

Figure 10:
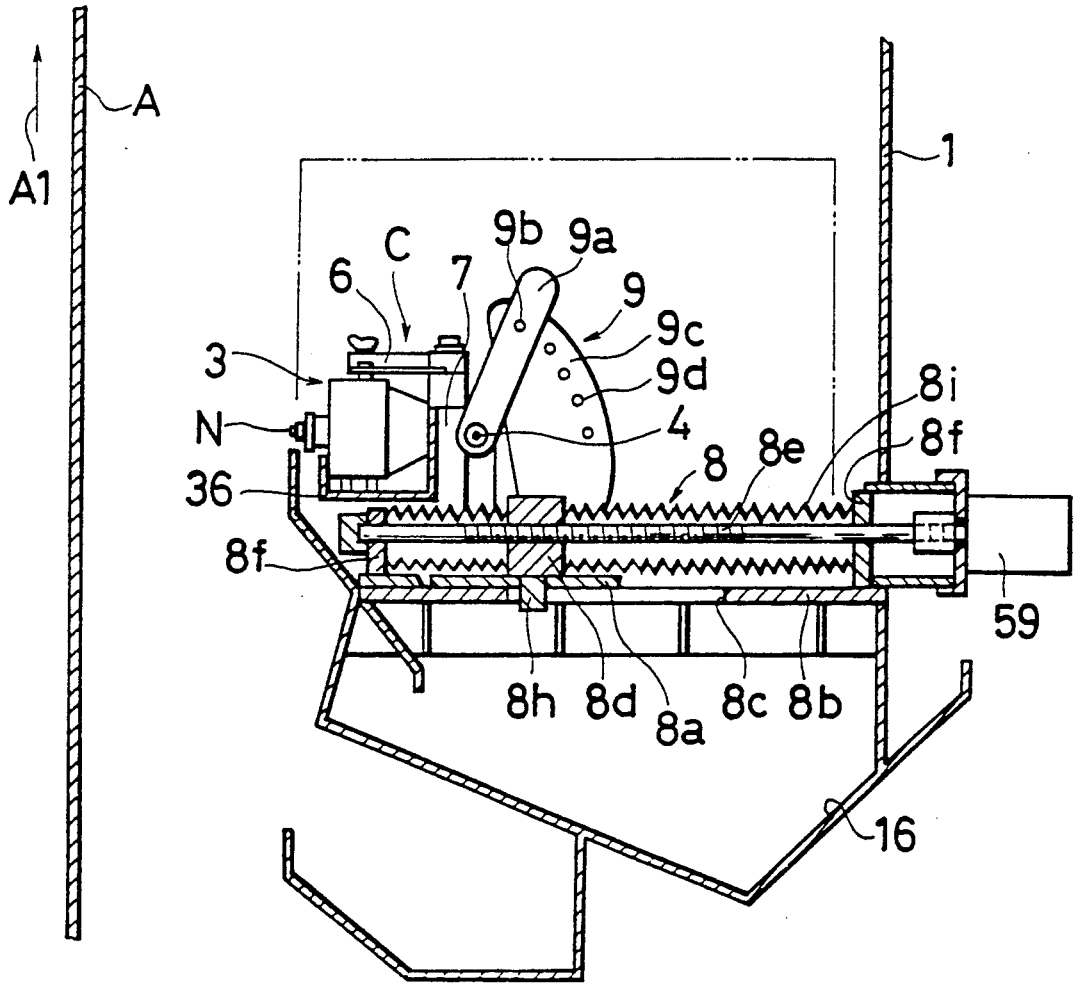
FIG. 10 is a schematic longitudinal sectional view showing a part of the manufacturing apparatus in FIG. 1.
Figure 11:
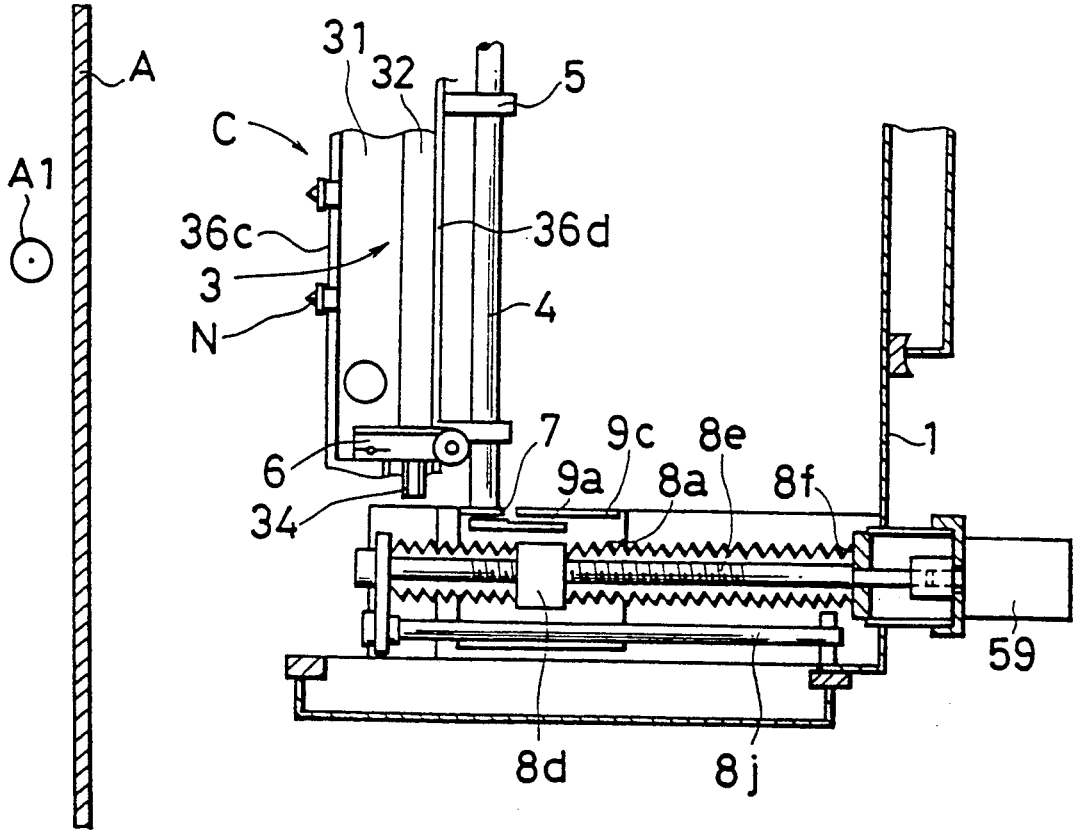
FIG. 11 is a schematic horizontal sectional view showing a part of the manufacturing apparatus in simplified form.

Next, as shown in FIGS. 10 and 11, the header 3 is fixed to the header support rod 4 which is parallel to the strip A and is horizontal, by way of the bracket 5, and is pushed down from above by the header fixing arm 6. Both ends of the support rod 4 are rotatably supported by a rod receiving plate 7.

A nozzle withdrawal means 8 is provided for drawing back the nozzle N from the strip A, and includes a rectangular horizontal slide plate 8*a* which the rod receiving plate 7 is mounted to and extends up from. The slide plate 8*a* is supported rotatably in the longitudinal direction on the upper surface of a horizontal base board 8*b*, and its vertical position is defined by a horizontal guide bar 8*j* which is elongated in the longitudinal direction. A nut member 8*d* is affixed to the upper surface of the slide plate 8*a*, and a guide pin 8*h* extends down from the lower surface of the nut member 8*d*. This pin 8*h* is guided so as to be movable in the longitudinal direction (the lateral direction as viewed in FIGS. 10 and 11), penetrating through the slit 8*c* of the base board 8*b*. In order to withdraw the nut member 8*d*, a nozzle withdrawal screw shaft 8*e* is extended horizontally in the longitudinal direction. The screw shaft 8*e* is rotatably supported by bearing plates 8*f* at both its ends, and one end of the screw shaft 8*e* is rotated and driven by a driving means 59 which projects through the casing 1. Between the bearing plate 8*f* and not member 8*d*, a protective bellows tube 8*i* is mounted about the circumference of the screw shaft 8*e* in order to prevent mist from depositing on the screw shaft. Instead of the driving means 59, a handle to be turned manually may be attached to the screw shaft 8*e*.

A nozzle angle adjusting means 9 is provided for adjusting the angle of the nozzle N with respect to the strip A and includes an angle adjusting lever 9*a* fixed to one end of the header support rod 4, and an angle setting plate 9*c* being set up on the slide plate 8*a*, such that the relative angle can be adjusted by inserting pins (not shown) into pin holes 9*b*, 9*d* disposed in the lever 9*a* and setting plate 9*c*, respectively.

The operation of the apparatus is described below. In the main spangle removing means B, when air is introduced into the air header 31 and liquid into the liquid header 32, they are mixed at the nozzle N through the nozzle lead-in members 35, and the mixture is sprayed toward the strip A. For example, one or some of the nozzles N of the main spangle removing means B are clogged, (1) the spare spangle removing means C can be operated, or (2) the tube connection cylinders 33, 34 of the main spangle removing means B can be separated, and the header 3 can be guided by the slide guide 36, and moved in the longitudinal direction of the header 3 (perpendicular to the sheet of FIG. 10, parallel to the sheet of FIG. 11) to be replaced with a spare header.

At the nozzle withdrawal means 8 for adjusting the distance of the nozzle N from the strip A, when the screw shaft 8*e* is rotated by the driving means 59, the nut member 8*d* retreats with respect to the strip A, and the slide plate 8*a* also retreats, such that the header support rod 4 is retracted rearwardly. As a result, the header retreats together with the slide plate 8*a* and rod 4, so that the distance between the nozzle N and strip A may be adjusted.

To adjust the angle of the nozzle N, the nozzle angle adjusting means 9 is operated, and the lever 9*a* is turned to change the fitting position of the pin with respect to the angle setting plate 9*c*.

In FIG. 1, at one side of the casing 1, passage doors 11*a* are disposed. Downwardly from the main spangle removing means B, a main convection preventing plate 12 is provided, and this main convection preventing plate 12 is spaced from the strip A, is mounted downward of the nozzle N, and stretches rearward of the nozzle header of the spare removing means C. Downwardly from the spare removing means C is disposed a spare convection preventing plate 15, and this spare convection preventing plate 15 is spaced from the strip A, is mounted downward of the nozzle of the spare removing means C, and extends above the spare drain trap 16. A main drain trap 13 is installed at the lower side of the main removing means B.

Referring again to FIG. 3, maintenance covers 17 are provided at four positions on one side wall of the casing 1 parallel to the strip A. At one side of the casing 1 orthogonal to the strip A, a mist exhaust hood 18 is mounted and communicates with the mist chamber 2, and the mist is exhausted upward by this hood 18. A mist hood cover 19 is disposed on this hood 18, and a drain pipe 20 extends downwardly from its lower end.

Here, the mist circulating in the casing is blocked by the main and spare convection preventing plates 12, 15, and drops of mist deposited on these convection preventing plates 12, 15 are received by the main drain trap 13 and spare drain trap 16, and are led to the outside of the casing. Since the main and spare convection preventing plates 12, 15 are disposed in the casing 1, circular flow of mist is blocked, and falling of water drips deposited on the inside of the casing 1 onto the strip A is prevented. Thus, the quality of this strip A is not adversely affected, and the yield is not lowered.

Since tube connection cylinders 33, 34 are attached to one end of each header 31, 32, there are few tube junctions, such that the assembly work efficiency is significantly improved, and possible air and liquid leaks are decreased accordingly. Therefore, on the whole, a compact and light weight header can be presented. Incidentally, if the header 3 is long, a partition board may be disposed midway in the longitudinal direction, and tube connection cylinders may be disposed at both ends in the longitudinal direction of the header.

Moreover, since the header is supported by slide guide which slidably guides the header in the lengthwise direction, if the nozzle is clogged, the header may be immediately removed and the nozzle replaced, or the header may be quickly replaced with a spare one.

The header 3 and the nozzle N of the invention may be utilized with not only manufacturing apparatus for minimized spangle molten plated steel plate, but also with other technical art. Other fluid than air or liquid may be pressure-fed into the header 3. Furthermore, liquid and gas may be pressure-fed into the header 31 and the header 32, respectively.

What is claimed is:

1. A two-fluid injecting apparatus comprising:

a first elongated header having a longitudinally extending front wall and a longitudinally extending rear wall and being adapted to be supplied with a first fluid;

a second elongated header mounted adjacent to and longitudinally along said longitudinally extending rear wall of said first elongated header and being adapted to be supplied with a second fluid;

a plurality of nozzle lead-in members, each of which extends through both said front wall and said rear wall of said first header, such that each of said plurality of nozzle lead-in members includes a rear end extending into said second header and a front end located forwardly of said front wall of said first header, each of said plurality of nozzle lead-in members including first fluid passage means for feeding the first fluid from within said first header through said front end of the respective nozzle lead-in member, and second fluid passage means for feeding the second fluid from within said second header through said front end of the respective nozzle lead-in member; and a plurality of nozzles, each of which is respectively detachably mounted to one of said plurality of nozzle lead-in members and includes a mixing chamber means for mixing the first and second fluids, first fluid communication means for feeding the first fluid from said first fluid passage means to said mixing chamber means, second fluid communication means for feeding the second fluid from said second fluid passage means to said mixing chamber means, and nozzle hole means for injecting a mixture of the first and second fluids forwardly from said mixing chamber means.

2. A two-fluid injecting apparatus as recited in claim 1, wherein said second fluid passage means comprises a single elongated passage formed axially through each of said plurality of nozzle lead-in members; and said first fluid passage means comprises a plurality of elongated passages formed through a front section of each of said plurality of nozzle lead-in members and about said single elongated passage of said second fluid passage means.

3. A two-fluid injecting apparatus as recited in claim 2, wherein each of said plurality of nozzles comprises a nozzle tip detachably mounted to a respective one of said nozzle lead-in members, and a cap mounted to a front end of said nozzle tip;

said second fluid communication means comprises a single elongated passage formed axially through each of said nozzle tips; and said first fluid communication means comprises a plurality of elongated passages formed through each of said nozzle tips and about said single elongated passage of said second fluid communication means.

4. A two-fluid injecting apparatus as recited in claim 3, wherein said plurality of elongated passages of said first fluid communication means are angled such that they converge forwardly and toward a central axis of said nozzle tip.

5. A two-fluid injecting apparatus as recited in claim 4, wherein said first fluid communication means further comprises an annular recess formed in a rear end of said nozzle tip and in communication with said plurality of elongated passages of said first fluid communication means and with said plurality of elongated passages of said first fluid passage means.

6. A two-fluid injecting apparatus as recited in claim 5, further comprising fluid check valve means for limiting flow of the second fluid through said second fluid communication means.

7. A two-fluid injecting apparatus as recited in claim 1, wherein each of said plurality of nozzles comprises a nozzle tip detachably mounted to a respective one of said nozzle lead-in members, and a cap mounted to a front end of said nozzle tip;

said second fluid communication means comprises a single elongated passage formed axially through each of said nozzle tips; and said first fluid communication means comprises a plurality of elongated passages formed through each of said nozzle tips and about said single elongated passage of said second fluid communication means.

8. A two-fluid injecting apparatus as recited in claim 7, wherein said plurality of elongated passages of said first fluid communication means are angled such that they converge forwardly and toward a central axis of said nozzle tip.

9. A two-fluid injecting apparatus as recited in claim 1, further comprising fluid check valve means for limiting flow of the second fluid through said second fluid communication means.

10. A two-fluid injecting apparatus as recited in claim 1, wherein said first fluid communication means, said second communication means and said mixing chamber means together define a means for atomizing the second fluid with the first fluid.

11. An apparatus for manufacturing minimized spangle molten plated steel plate, said apparatus comprising:

a casing having a strip passage defined vertically therethrough to allow a strip of steel plate to pass therethrough in an upward direction; and a pair of spangle removing apparatus mounted in said casing on respectively opposing sides of said strip passage, each of said pair of spangle removing apparatus comprising a main spangle removing means for removing spangle from the steel strip, and a spare spangle removing means, mounted below said main spangle removing means, for removing spangle from the steep strip independently of said main spangle removing means, each of said main spangle removing means and said spare spangle removing means comprising a first elongated header having a longitudinally extending front wall and a longitudinally extending rear wall and being adapted to be supplied with a first fluid, a second elongated header mounted adjacent to and longitudinally along said longitudinally extending rear wall of said first elongated header and being adapted to be supplied with a second fluid, a plurality of nozzle lead-in members, each of which extends through both said front wall and said rear wall of said first header, such that each of said plurality of nozzle lead-in members includes a rear end extending into said second header and a front end located forwardly of said front wall of said first header, each of said plurality of nozzle lead-in members including first fluid passage means for feeding the first fluid from within said first header through said front end of the respective nozzle lead-in member, and second fluid passage means for feeding the second fluid from within said second header through said front end of the respective nozzle lead-in member, and a plurality of nozzles, each of which is respectively detachably mounted to one of said plurality of nozzle lead-in members and includes a mixing chamber means for mixing the first and second fluids, first fluid communication means for feeding the first fluid from said first fluid passage means to said mixing chamber means, second fluid communication means for feeding the second fluid from said second fluid passage means to said mixing chamber means, and nozzle hole means for injecting a mixture of the first and second fluids forwardly from said mixing chamber means.

12. An apparatus as recited in claim 11, wherein said second fluid passage means comprises a single elongated passage formed axially through each of said plurality of nozzle lead-in members; and said first fluid passage means comprises a plurality of elongated passages formed through a front section of each of said plurality of nozzle lead-in members and about said single elongated passage to said second fluid passage means.

13. An apparatus as recited in claim 12, wherein each of said plurality of nozzles comprises a nozzle tip detachably mounted to a respective one of said nozzle lead-in members, and a cap mounted to a front end of said nozzle tip;

said second fluid communication means comprises a single elongated passage formed axially through each of said nozzle tips; and said first fluid communication means comprises a plurality of elongated passages formed through each of said nozzle tips and about said single elongated passage of said second fluid communication means.

14. An apparatus as recited in claim 13, wherein said plurality of elongated passages of said first fluid communication means are angled such that they converge forwardly and toward a central axis of said nozzle tip.

15. An apparatus as recited in claim 14, wherein said first fluid communication means further comprises an annular recess formed in a rear end of said nozzle tip and in communication with said plurality of elongated passages of said first fluid communication means and with said plurality of elongated passages of said first fluid passage means.

16. An apparatus as recited in claim 15, further comprising fluid check valve means for limiting flow of the second fluid through said second fluid communication means.

17. An apparatus as recited in claim 11, wherein each of said plurality of nozzles comprises a nozzle tip detachably mounted to a respective one of said nozzle lead-in members, and a cap mounted to a front end of said nozzle tip;

said second fluid communication means comprises a single elongated passage formed axially through each of said nozzle tips; and said first fluid communication means comprises a plurality of elongated passages formed through each of said nozzle tips and about said single elongated passage of said second fluid communication means.

18. An apparatus as recited in claim 17, wherein said plurality of elongated passages of said first fluid communication means are angled such that they converge forwardly and toward a central axis of said nozzle tip.

19. An apparatus as recited in claim 11, further comprising fluid check valve means for limiting flow of the second fluid through said second fluid communication means.

20. An apparatus as recited in claim 11, wherein said first fluid communication means, said second communication means and said mixing chamber means together define a means for atomizing the second fluid with the first fluid.

21. An apparatus as recited in claim 11, further comprising main convection preventing means for preventing convection of mist within said casing, said main convection preventing means comprising a pair of plates respectively mounted on opposing sides of said strip passage so as to be spaced from the steel strip and extending downwardly from below each of said main spangle removing means, respectively; and spare convection preventing means for preventing convection of mist within said casing, said spare convection preventing means comprising a pair of plates respectively mounted on opposite sides of said strip passage so as to be spaced from the steel strip and extending downwardly from below each of said spare spangle removing means, respectively.

22. An apparatus as recited in claim 11, further comprising rail means for individually moving each of said main spangle removing means and spare spangle removing means in a longitudinal direction of said first and second elongated headers.

23. An apparatus as recited in claim 11, further comprising angular adjusting means for adjusting an angular inclination at which the mixture of the first and second fluids is injected from said nozzle hole means relative to the steel strip by individually adjusting an angle of each of said main spangle removing means and spare spangle removing means relative to said strip passage.

24. An apparatus as recited in claim 11, further comprising approaching/retreating means for individually moving each of said main spangle removing means and said spare spangle removing means toward and away from the steel strip in a direction perpendicular to the longitudinal direction of said first and second elongated headers.

* * * * *